US005744772A

United States Patent [19]

Fasano

[11] Patent Number: 5,744,772

[45] Date of Patent: Apr. 28, 1998

[54] MOLDED CASE CIRCUIT BREAKER WITH ARC SUPPRESSANT FEATURES INCLUDING MAGNETICALLY PERMEABLE ARC HORN MOUNTED ON THE CONTACT ARM

[75] Inventor: Michael A. Fasano, Watertown, Conn.

[73] Assignee: Carlingswitch, Inc., Plainville, Conn.

[21] Appl. No.: 695,176

[22] Filed: Aug. 1, 1996

[51] Int. Cl.[6] ..... H01H 9/44; H01H 9/30

[52] U.S. Cl. ..... 218/40; 218/148; 218/36

[58] Field of Search ..... 335/16, 195, 201, 335/194; 218/22, 23, 27, 36–42, 146–149, 151

[56] References Cited

U.S. PATENT DOCUMENTS

| | | | |
|---|---|---|---|
| 4,642,428 | 2/1987 | Yoshiyasu et al. | 200/144 R |
| 4,885,441 | 12/1989 | Hisatsune et al. | 200/144 R |
| 5,004,878 | 4/1991 | Seymour et al. | 200/144 R |
| 5,093,544 | 3/1992 | Lesslie et al. | 200/244 |
| 5,097,104 | 3/1992 | Weichert | 200/144 R |
| 5,184,099 | 2/1993 | DiMarco et al. | 335/16 |
| 5,493,091 | 2/1996 | Devautour et al. | 218/30 |
| 5,589,672 | 12/1996 | Uchida et al. | 218/34 |

*Primary Examiner*—Michael L. Gellner
*Assistant Examiner*—Michael J. Hayes
*Attorney, Agent, or Firm*—McCormick, Paulding & Huber

[57] ABSTRACT

An electromagnetic circuit breaker is provided with a copper plated arc horn on the top side of the movable contact arm opposite the movable contact. The horn extends beyond the movable contact and has an upturned sweep so as to enhance migration of the electrical arc created upon opening of the contacts during a short circuit condition sensed by the breaker. An arc shoe is provided in conjunction with the fixed contact of the breaker as well and cooperates with the arc horn for the same purpose.

3 Claims, 3 Drawing Sheets

MOLDED CASE CIRCUIT BREAKER WITH ARC SUPPRESSANT FEATURES INCLUDING MAGNETICALLY PERMEABLE ARC HORN MOUNTED ON THE CONTACT ARM

BACKGROUND OF THE INVENTION

This invention relates generally to electromagnetic circuit breakers of the type having a housing made in two half sections, each of which sections is molded from a plastic dielectric material. The half sections are held together by fasteners so as to support a circuit breaker mechanism and terminal components between these half sections.

Such circuit breakers are designed to provide load current and voltage through an electromagnetic coil that surrounds a delay tube in which a plunger or core is adapted to be drawn magnetically toward a pole piece at the end of the delay tube by the flux created in a frame and an armature. The frame is mounted between the circuit breaker half sections to support for both the coil, generally on a bobbin or the like, and also to support the circuit breaker mechanism that is adapted to be tripped by the movable armature.

The armature engages a sear to open the electrical contacts provided in an arc chamber that is also defined in the housing. The arc chamber may be vented to release gases generated when the contacts open. This avoids the build up of excessive heat and pressure within the circuit breaker housing.

The molded half sections of the circuit breaker housing are generally provided with angled slots to receive U-shaped arc splitter plates that are arranged in spaced relationship along the path of movement for the movable contact as it travels from a closed position, in engagement with the fixed contact provided on one of the terminal studs in the circuit breaker housing, to an open position where it is spaced from the fixed contact. The movable contact is generally provided on the underside of the movable contact arm for this purpose. The contact arm provides for the electrical path through the movable contact to the fixed contact in the contacts closed condition of the circuit breaker.

SUMMARY OF THE INVENTION

The present invention relates to improving the arc suppressant capabilities of the breaker. A unique arc horn is provided on the movable contact arm and a shoe is provided on the fixed contact. The horn is designed to drive the arc created upon opening of the contacts further into the U-shaped arc splitter plates than has been possible with prior art configurations that rely only the arc plates themselves to achieve suppression of the arc.

In accordance with the present invention, the electromagnetic circuit breaker housing is defined by molded half sections which are adapted to receive these arc splitter plates in a conventional fashion so as to provide a series of spaced U-shaped plates through which the movable contact passes as it moves from a closed to an open position. The movable contact is provided on the underside of the contact arm and in accordance with the present invention, a copper plated magnetically permeable horn is secured to the top side of the contact arm. The arc horn preferably extends outwardly beyond the end of the arm and beyond the movable contact, and preferably has an upturned end portion that serves to magnetically shift the arc caused upon opening movement of the movable contact during a short circuit condition driving the arc more deeply into the array of U-shaped arc splitters plates, thereby reducing not only the temperature and pressure within the circuit breaker housing, but also helping to extinguish the arc somewhat sooner than has been possible with prior art arc chamber configurations.

In further accordance with the present invention, the fixed contact is provided with an arc shoe that extends in generally the same direction as the arc horn. Such a shoe is also copper plated and magnetically permeable, and also functions to drive the arc further into the arc plates. Thus, the arc horn provided on the movable contact arm and the arc shoe combine to improve the arc suppressant characteristics of a circuit breaker fitted with these improvements of the present invention.

BRIEF DESCRIPTION OF THE DRAWINGS

The magnetic flux created by the arc itself is illustrated in phantom lines.

DETAILED DESCRIPTION OF THE EMBODIMENT ILLUSTRATED IN FIGS. 1–3B

Figure 1:
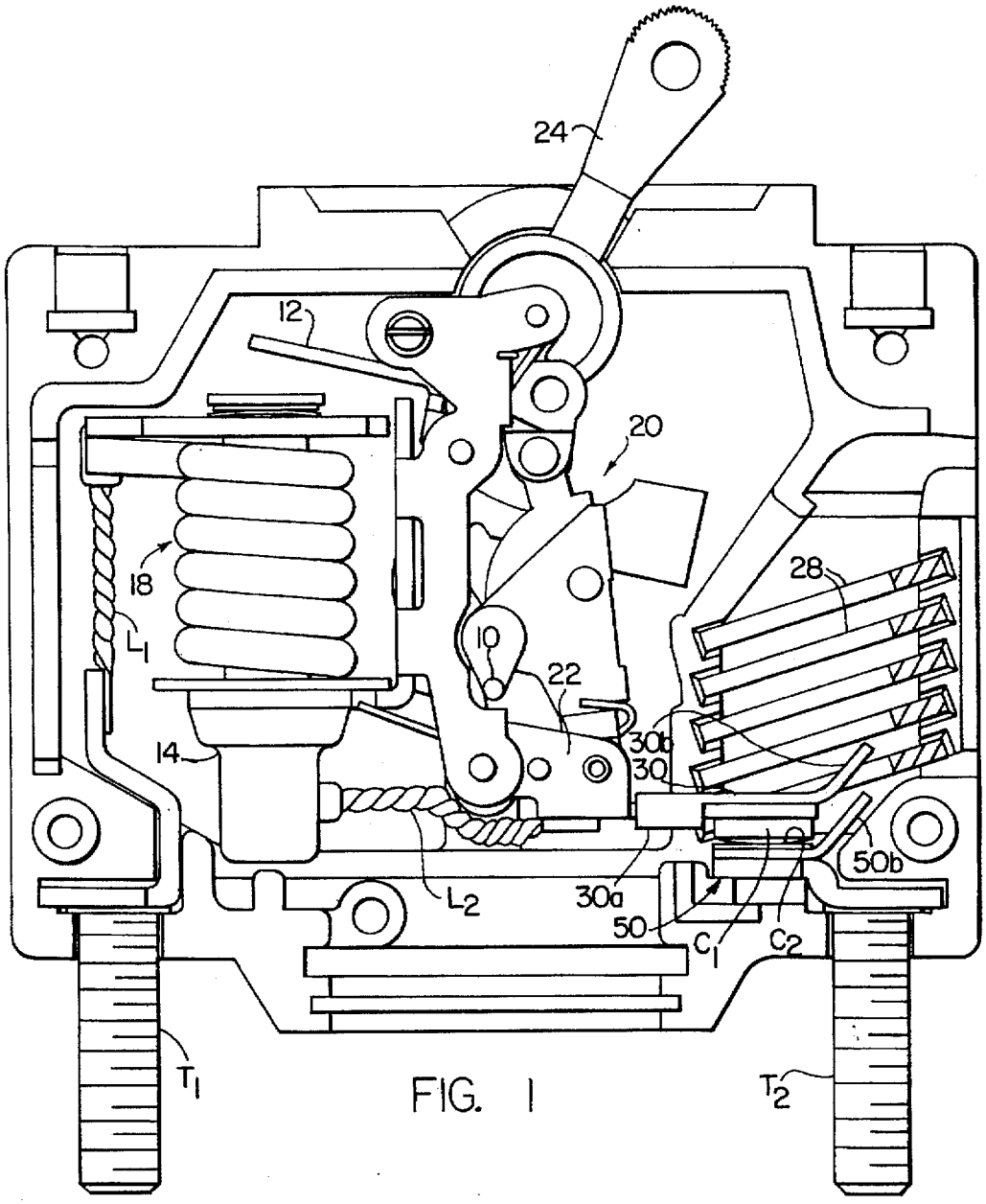
FIG. 1 is an elevational view illustrating one-half section of the molded case circuit breaker housing showing the various components of a typical circuit breaker mechanism including the electromagnetic frame assembly and the terminals which provide the current and voltage through the breaker mechanism so that upon sensing an over current condition, the movable contact will move from the closed position shown in FIG. 1 to the open position shown in FIG. 2.

Turning now to the drawings in greater detail, FIG. 1 shows a magnetic circuit breaker having a conventional circuit breaker mechanism such as that disclosed in U.S. Pat. No. 4,347,488 entitled "MULTI-POLE CIRCUIT BREAKER" issued Aug. 31, 1982 and assigned to the assignee herein. Such a circuit breaker mechanism includes a collapsible link 20 that is provided between a movable contact arm 22 and a pivotably mounted toggle actuator 24. The collapsible link is adapted to be operated without collapsing by the actuator 24 so as to achieve direct opening and closing movement of the movable contact arm 22 between the positions illustrated in FIG. 1 and FIG. 2 herein. Such a circuit breaker is connected in a circuit to be protected through terminals $T_1$ and $T_2$. Terminal $T_1$ is connected by a lead $L_1$ to an internal electromagnetic coil 18, and from the coil to the movable contact arm by a lead $L_2$. When the movable contact arm 22 is in the position shown for it in FIG. 1, a movable contact $C_1$ provided on the movable contact arm 22 engages a fixed contact $C_2$ mounted on the fixed post or terminal $T_2$. Thus, electrical current can flow through the coil 18 and, unless that current flow is manually interrupted by movement of the toggle actuator 24, the current in any circuit in which the circuit breaker is provided will continue to flow until the current in that circuit and hence in the coil 18 exceeds a predetermined level for the magnetic circuit breaker for which the magnetic circuit breaker is designed. At this point, such over current condition in the coil 18 will alter the magnetic circuit of the breaker mechanism pulling a core (not shown) inside the coil and inside the element 14 upwardly, thereby drawing the armature 12 downwardly. The armature 12 includes a depending leg (not shown) that will cause the pin means 10 to rotate in a counterclockwise direction collapsing the link 20 so that the spring biased movable contact arm 22 moves from its closed position of FIG. 1 to the open position illustrated in FIG. 2.

Figure 2:
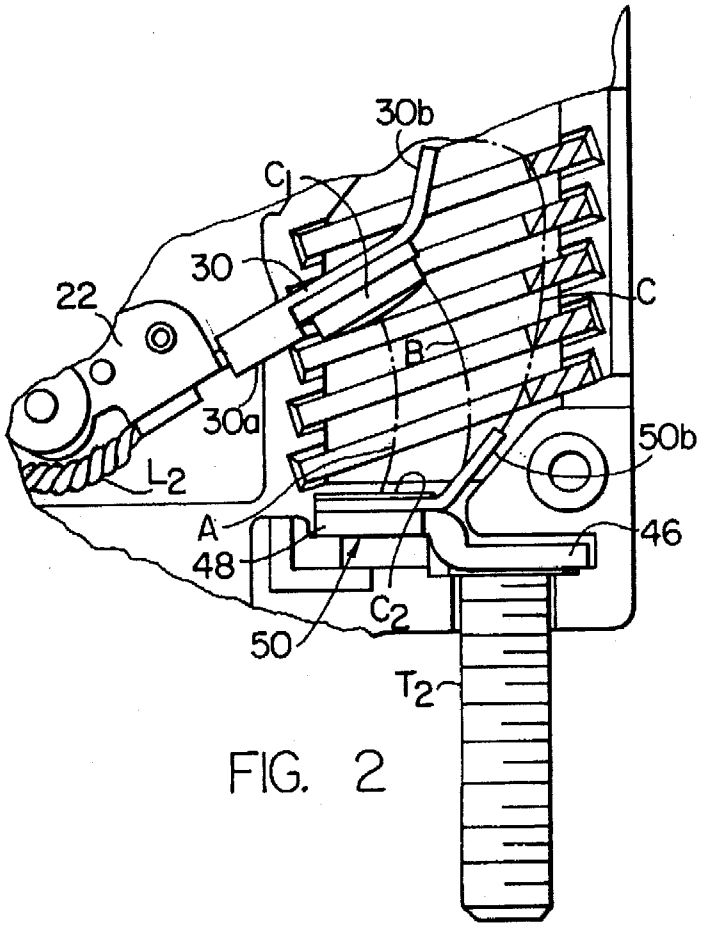
FIG. 2 is view similar to FIG. 1, but illustrating only that portion of the circuit breaker necessary to illustrate the operation of the movable contact arm and arc shoe associated with the present invention. This view illustrates at Lines A, B, and C, the successive locations for the arc as it is shifted during opening movement of the movable contact arm from the FIG. 1 to the FIG. 2 position.

It is a characteristic of such circuit breakers generally that opening movement of the contacts as described in the preceding paragraph is accompanied by the formation of an electrical arc between the movable contacts and such an arc is indicated generally by the Line A in FIG. 2. The present invention provides an improved arc horn on the movable contact arm 22, which preferably operates in conjunction with an improved arc shoe on the support structure for the fixed contact $C_2$, so as to induce a unique magnetic field between the horn and the shoe. As a direct result of this magnetic field the arc will migrate toward the tip of the horn and generate an increased voltage for the arc, reducing the current in the arc, and hence providing a cooler arc condition inside the breaker housing.

The arc horn associated with the movable contact and the arc shoe associated with the fixed contact cooperate with the arc splitter plates indicated generally at 28 in FIG. 2 to further enhance the extinction of the arc inside the circuit breaker housing upon tripping of the breaker due to an over current condition.

Figure 3A:
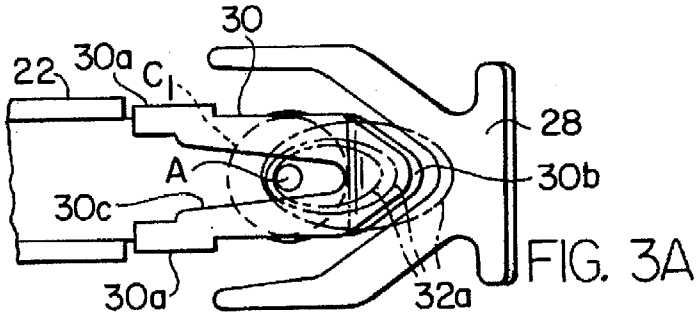
FIG. 3A shows the arc on the line A of FIG. 2 relative to the arc horn provided on the movable contact arm. The location of the movable contact relative to the horn is illustrated in broken lines in FIG. 3A for references purposes.

In accordance with the present invention, the configuration of the movable contact arm is altered, at least in a magnetic sense, by the addition of a magnetically permeable arc horn 30, the configuration for which arc horn 30 is best illustrated in 3A, 3B and 3C. As shown in FIG. 3A, the arc horn extends outwardly beyond the movable contact arm and in a direction away from its pivoted end into the region of the arc splitter plates designated by reference numeral 28. For references purposes in FIG. 3A, the location for the movable contact $C_1$ on the contact arm 22 is illustrated generally at $C_1$. It will be apparent that the electrical arc created upon an over current condition is at least initially oriented between the contacts $C_1$ and $C_2$ on the line A in FIG. 2. Thus, the current in the arc is initially oriented as suggested generally at A in FIG. 3A. However, the magnetically permeable arc horn 30 provided on the end of the movable contact arm 22 causes a magnetic flux pattern depicted by the concentric rings at 32*a* in FIG. 3A. This magnetic flux pattern or field has an effect on the arc itself. This flux field will move the arc outwardly along the movable contact arm as suggested in FIG. 3B.

Figure 3B:
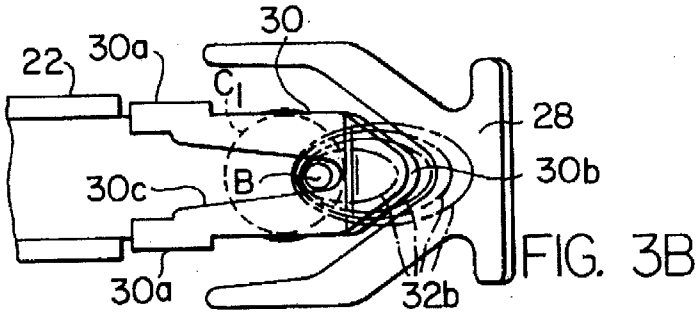
FIGS. 3B and 3C are similar to FIG. 3A but illustrate the result of the magnetic flux pattern created in FIG. 3A and the shifting of the arc outwardly of the contact arm. This view also shows in broken lines the relationship between the arc horn and the arc splitter plates in the housing.
Figure 3C:
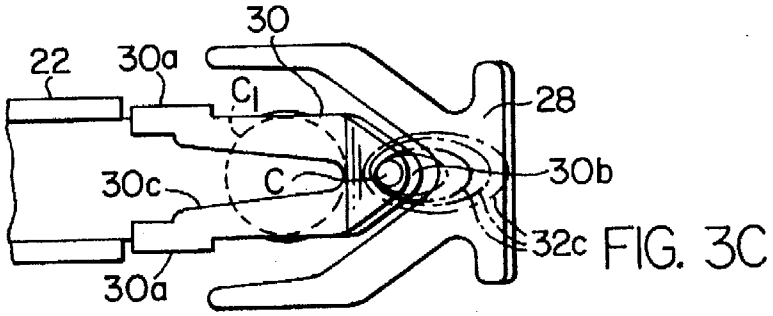

In further accordance with the present invention, the arc horn 30 is not only fabricated from a permeable material, as mentioned previously, but is also copper plated so as to enhance the arc's transition time. The combination of the arc horns geometry, its magnetically permeable material and this copper coating combine to draw the arc outwardly of the arm 22 and into the geometry of the arc splitter plates 28 as indicated in the successive views 3B and 3C. These successive sketches for the arc at A, B, C in FIGS. 3A, 3B and 3C are intended to show that the arc quickly reaches a position at the end of the arc horn 30. With reference to FIG. 2, the lines A, B and C represent the relative location of the arc as it migrates outwardly of the movable contact arm and into the grid defined by the arc splitter plates 28.

Referring now to a more detailed description of the geometry of the arc horn 30, it will be apparent that this part is fabricated from an initially flat strip of metal which is cut or stamped with an appropriate planform to allow legs 30*a* to be bent around the movable contact arm 22. In addition to being copper plated, the contact arm may be spot welded to the arm in accordance with conventional techniques.

In summary, the invention disclosed in FIGS. 1–3C provides a convenient structure for causing the arc to migrate from the initial position for the arc as depicted in FIG. 3A through and ultimately to a position such as that illustrated at C in FIG. 3C due to the magnetic flux pattern created by the geometry of the arc horn 30. It should be noted that the arc horn not only includes an upturned end portion 30*b* as best illustrated in FIG. 1 such that the horn extends beyond the end of the movable contact lever and movable contact, but the arc horn 30 further includes a recess 30*c* such that the arc horn is generally U-shaped in configuration with the majority of its material distributed along the marginal edge portions thereof. The U-shaped arc horn 30 is mounted on the movable contact arm 22 by ears 30*a*, 30*a* at the marginal edges of the U-shaped legs as shown in FIGS. 2 and 3A through 3C inclusively. It is this geometry which creates the magnetic flux field described previously with reference to FIG. 3A and illustrated at 32*a* in that view. Ultimately, the flux pattern is altered as the arc migrates outwardly of the arm 22 and into a target area which is at the base of U-shaped arc horn, and hence in the grid created by the arc splitter plates 28 to assume the shape shown for it at 32*b* in FIG. 3*b* and the configuration shown at 32*c* in FIG. 3C.

DETAILED DESCRIPTION OF FIGS. 4, 5 AND 6

Figure 5:
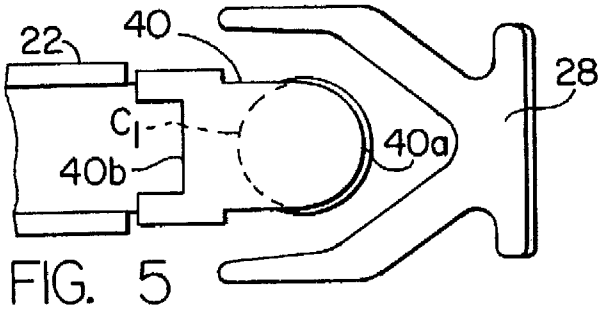
FIG. 5 is a view taken generally on the line 5,5 of FIG. 4 illustrating the upper side of the movable contact arm in the embodiment of FIG. 4.
Figure 4:
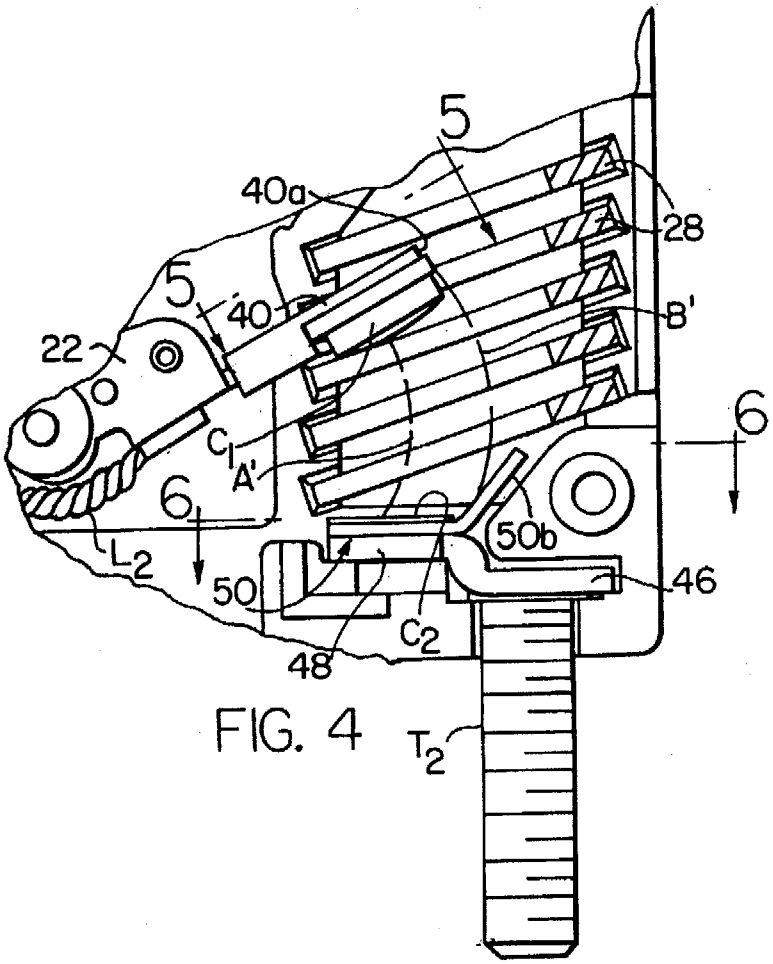
FIG. 4 is a view of an alternative embodiment for the arc horn of FIGS. 1–3, but with the remaining portions of the breaker being identical to that depicted in FIGS. 1–3 including the fixed contact and its support stud or terminal.

Turning now to the embodiment illustrated in FIG. 4, the movable contact arm 22 and associated movable contact $C_1$ are identical to those described previously as is most of the circuit breaker mechanism itself. However, the arc horn provided on the movable contact arm 22 differs slightly in that it does not include the extended upturned tip portion 30*b* described with the reference to the arc horn 30 of the previous embodiment. Instead the arc horn 40 of FIG. 4 has the geometry depicted for it in FIG. 5 where the outer end of the horn 40*a* extends to the end of the movable contact $C_1$, and wherein the relieved portion 40*b* does not extend as far into the region of the movable contact $C_1$. Nevertheless, some advantages of the present invention are realized with the arc horn of FIGS. 4 and 5 since the material from which the arc horn is fabricated comprises the same magnetically permeable base material and is also copper plated, thereby creating a situation which causes the arc to migrate from an initial position such as that shown at $A^1$ in FIG. 4 to the position shown at $B^1$ in FIG. 4.

In summary it will be apparent that the arc horn 40 differs from that described previously with reference to the arc horn 30, in that the relieved area 40b is not as deep as that for the previously described arc horn 30 nor does the tip or end portion of the arc horn 40 extend beyond the contact $C_1$ as was the case with the tip 30b of the arc horn 30 described with reference to the previous embodiment. Nevertheless, some of the advantages of the present invention can be realized as a result of the fact that the arc horn 40 is also fabricated from a magnetically permeable material, and is copper plated to enhance arc transition time. In short, such an arc horn configuration does create a situation where the arc migrates from the position shown at $A^1$ in FIG. 4 to that illustrated at $B^1$ in FIG. 4.

These advantages of the present invention are further enhanced by reason of a fixed arc shoe 50 provided in outwardly projecting relationship to the fixed contact $C_2$, and also fabricated from a magnetically permeable metal that has been copper plated to enhance the migration of the arc current away from the contact and in a direction opposite the pivoted end of the contact arm. It is important to prevent this arc from moving inwardly toward the pivoted end of the contact arm because damage to the breaker mechanism can be expected if such regressive arc migration should occur.

Figure 6:
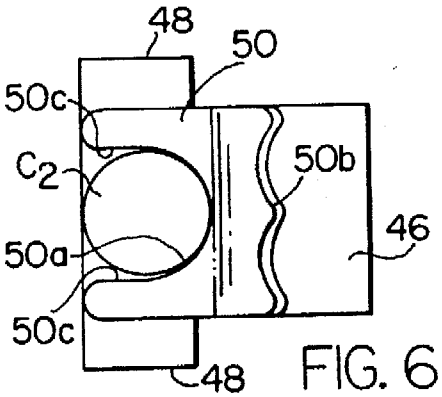
FIG. 6 is a sectional view taken along the lines 6,6 of FIG. 4 but eliminating all the parts except for the stud terminal and the fixed contact with its associated arc shoe.

FIG. 6 shows the fixed contact $C_2$ mounted on an upper portion of the stud terminal $T_2$. As shown, this portion of stud terminal $T_2$ has a lateral extent that serves to secure this component in the split case circuit breaker housing, by means of the ears 48,48. The stud terminal $T_2$ further includes a projecting portion 46 that serves to interconnect the contact bearing portion with the ears 48 to the threaded stud $T_2$ as best shown in FIG. 2.

Turning now to a more detailed description of the copper plated arc shifting fixed contact shoe 50, it can be seen from FIG. 6 that a recessed portion 50a serves to surround the contact $C_2$. An upturned portion with a scalloped edge 50b cooperates with the leg portions 50c of the arc shoe and serves to enhance the magnetic flux pattern as generated by the electric current in the arc $A^1$ in FIG. 4 to cause the arc to shift from the position for it at $A^1$ in FIG. 4 to that illustrated at $B^1$ in that view.

Returning momentarily to the explanation given with reference to the embodiment of FIGS. 1–3C, it will be apparent from FIG. 1 that the upturned portion 30b of the movable arc horn 30 lies generally parallel to and in closely spaced relationship to the upturned end portion 50b of the arc shoe 50. Thus, and as best shown in FIG. 2 and still with reference to the first above-described embodiment of the invention, the propensity for the arc itself to migrate from the position shown for it at A in FIG. 2 to the ultimate position illustrated for it at C in FIG. 2, is enhanced by the arc shoe described in the preceding paragraphs with reference to FIG. 6. Thus, the first above-described embodiment of FIGS. 1–3C preferably includes the same arc shoe 50 associated with the same fixed contact as that described with reference to the second embodiment of FIGS. 4 and 5.

In conclusion, the combination of an arc horn when taken together with an arc shoe, provided respectively on the end of the movable contact arm, and on the fixed stud associated with the fixed contact provides an improved circuit breaker capable of accommodating short circuit currents and associated arcing of the breaker contacts. More particularly, the present invention not only avoids the propensity for the arc to deteriorate the contacts as a result of remaining in the position illustrated at A and $A^1$ in the above-described embodiments, but avoids regression of the arc rearwardly toward the pivoted end of the movable contact arm. More specifically, this invention provides for migration of the arc away from the movable and fixed contacts, to a location where the arc is stretched out and can be better controlled by the fixed arc splitter plates provided in the circuit breaker. The concept of providing for a magnetically permeable material for the arc horn and the arc shoe when taken in combination with the copper plating provided on these components improving the capability of a breaker equipped with these components to more quickly extinguish or at least reduce the effects of arcing in the circuit breaker tripped by a short circuit condition. The magnetic field induced in the horn by the current flow draws the arc towards the tip of the horn thereby stretching the arc and generating a relatively high arc voltage (as opposed to a high arc current). As a result the surrounding circuit breaker structure is not heated by the arc to the extent that would occur absent these uniquely configured components.

I claim:

1. A circuit breaker having a housing defining an internal chamber, a circuit breaker mechanism provided in said chamber and including a pivotable movable contact arm which moves from a closed to an open position in response to an overcurrent condition that is detected by said circuit breaker mechanism, a movable contact provided on the underside of said movable contact arm, a copper plated magnetically permeable arc horn on the upper side of said contact arm, said arc horn having a generally U-shaped configuration with the legs of the "U" defining ears for mounting said arc horn on said movable contact arm, said U-shaped are horn further including an upstanding base portion that extends beyond the free end of the movable contact arm and beyond said movable contact, said base defining a target area for locating the electric arc generated during a short circuit condition, a fixed contact provided for engagement by said movable contact when the movable contact arm is moved downwardly to a closed position, an arc shoe associated with said fixed contact and including portions alongside the fixed contact, said arc shoe further including a portion projecting upwardly and outwardly of said fixed contact to enhance the migration of an arc created between said fixed and movable contacts as a result of upward opening movement of the movable contact arm, which arc is driven in a direction away from the end of the movable contact as a result of said upwardly extending portion of said arc horn in conjunction with the upwardly and outwardly projecting portion of said arc shoe.

2. The circuit breaker according to claim 1, wherein said housing comprises a split housing having arc splitter plate slots, arc splitter plates provided in said slots and each plate being of general U-shape so that said plates cooperate to define a path for the pivotably movable contact and its associated arc horn, which path lies generally between the legs of said U-shaped arc splitter plates.

3. The circuit breaker according to claim 1 further characterized by a fixed stud terminal supporting said fixed contact, and said arc shoe provided on the same side of said fixed contact as that of said fixed stud.

* * * * *